US010875354B2

(12) United States Patent
Robinson

(10) Patent No.: US 10,875,354 B2
(45) Date of Patent: Dec. 29, 2020

(54) PAINT TRAY WITH A TRIPLE EMBODIMENT FURCATE MEANS WITH APPENDED CONTIGUOUS BINARY PAINT STIRRING IMPLEMENTS

(71) Applicant: Alec Robinson, Buninyoung (AU)

(72) Inventor: Alec Robinson, Buninyoung (AU)

(73) Assignee: Jiangsu Weixu M&E Co., Ltd., Taizhou (CN)

( * ) Notice: Subject to any disclaimer, the term of this patent is extended or adjusted under 35 U.S.C. 154(b) by 437 days.

(21) Appl. No.: 15/745,717

(22) PCT Filed: Jul. 18, 2016

(86) PCT No.: PCT/AU2016/000254
§ 371 (c)(1),
(2) Date: Jan. 18, 2018

(87) PCT Pub. No.: WO2017/011851
PCT Pub. Date: Jan. 26, 2017

(65) Prior Publication Data

US 2020/0079140 A1 Mar. 12, 2020

(30) Foreign Application Priority Data

Jul. 20, 2015 (AU) ..... 2015902870

(51) Int. Cl.
*B44D 3/12* (2006.01)
*B05C 17/02* (2006.01)
*B44D 3/06* (2006.01)

(52) U.S. Cl.
CPC ..... *B44D 3/126* (2013.01); *B05C 17/0245* (2013.01); *B44D 3/06* (2013.01)

(58) Field of Classification Search
CPC ..... B44D 3/126; B44D 3/125; B44D 3/128; B44D 3/06; B05C 17/0245; B65D 25/28; B65D 21/0201; B65D 21/043
USPC ..... 220/756, 570, 736, 735, 695, 23.4, 23.2; 206/507
See application file for complete search history.

(56) References Cited

U.S. PATENT DOCUMENTS 3,264,672 A * 8/1966 Campbell ..... B44D 3/126 15/257.06
2010/0065562 A1* 3/2010 Vovan ..... B65D 21/0206 220/23.4

* cited by examiner

*Primary Examiner* — Robert J Hicks
(74) *Attorney, Agent, or Firm* — Patshegen IP LLC

(57) ABSTRACT

A Paint tray with a triple embodiment in an inverted, reversible arrangement comprises a master surmount planar board embodiment and when inverted encapsulates dual smaller Paint trays with a furcate separation section the side walls of the Paint tray encapsulates dual binary Paint stirring implements which are extricated and detachable.

4 Claims, 13 Drawing Sheets

PAINT TRAY WITH A TRIPLE EMBODIMENT FURCATE MEANS WITH APPENDED CONTIGUOUS BINARY PAINT STIRRING IMPLEMENTS

This invention relates to the Paint industries and in particular, the Paint tray manufacturers. Over the years Paint tray manufacturers have designed the conventional Paint tray encapsulating the usual featured embodiments namely comprising a rectangular arrangement in design, with perpendicular walls, alternatively defining the incline planar base platform, comprises the desired embossed raised ribs for the Paint roller nap to athwart in a forward and backward action in a body of paint, also encapsulating the paint reservoir at the distal end of the Paint tray. The said Paint tray manufacturers have consistently designed Paint trays in a mono arrangement, housing Paint brush holders at the ends, also offering Paint tray liners with the said Paint tray arrangement as an added advantage.

Hitherto this invention encapsulates a dual sided inverted Paint tray in one tooling application and or alternatively comprises a mono configuration in a conventional embodiment. A further value-added appended embodiment of Paint stirrer implements are abutted and housed either end of the aforementioned Paint tray arrangement.

It is therefore these concepts that have brought about this present invention whereby the aforementioned Paint tray surface is of a conventional means of existing Paint trays whereby oil or water base paints are deployed. The exception of this embodiment maximizes the said surface and the base underside in one arrangement when inverted becomes the aforementioned dual sided inverted arrangement of the said Paint tray.

Furthermore the said Paint stirrer implements are housed and again abutted within the said Paint tray arrangement on the sides in a desired vertical perpendicular or flat horizontal wing-like means. This contiguous arrangement of embodiments is designed with a plurality of securement means, respectively the said Paint stirrer implements are removable by a detaching means by cutting, breaking off manually or mechanically or the like. This integration of the said Paint stirrer implements are manufactured in one mechanism on both sides of the said Paint tray, in a curvilinear embodiment, comprising a plurality of oval or round orifices or the like which allows the said Paint to ingress through a stirring action within the said Paint can. Also defining at the opposing distal ends of the said Paint tray a prehensile grip means within the configuration and orifices for storage.

SUMMARY OF THE INVENTION

The preferred effect of this invention is to provide a Paint tray with the conventional embodiment which comprises a dual purpose inverted embodiment for oil or water base paint.

Another preferred object of this invention comprises means a conventional mono arrangement alternatively of the above aforementioned.

Another preferred object of this invention is to respectively minimize cost to the end user skilled in the art of Painting to acquire triple paint trays and dual appended Paint stirrer implements integrated into a singular cost of manufacture.

In another preferred object of this invention the said integral Paint stirrer implements are detachable from the said Paint tray embodiment by the aforementioned described means.

In a another preferred object of this invention constitutes at the distal ends of the said Paint tray a prehensile grip means for handling, comprising an orifice or the like for storing after use like hanging on a wall, etc.

In another preferred object of this invention the said dual purpose inverted Paint tray means embodiment comprises dual sizes at opposing inverted ends, whereby the second Paint tray surface is smaller and housed within the larger Paint tray, when inverted with aforementioned descriptions.

In another preferred object of this invention the said dual purpose inverted or reversible conjoint Paint trays encapsulates a single wall embodiment separating dual juxtaposed smaller Paint trays with alternate widths in the inverted position.

In another preferred object of this invention of the said dual purpose Paint tray is to encapsulate a master surmount planar board embodiment with a furcate separation means, and when inverted or reversible conjointly encapsulates dual juxtaposed smaller Paint trays with a gutter furcate separate means, in a triple embodiment.

In a final preferred object of this invention the said dual purpose inverted Paint tray comprises means the larger Paint tray surface and when inverted encapsulates two other smaller Paint trays with surfaces housed, abutted and juxtaposed, within a said embodiment.

BRIEF DESCRIPTION OF THE DRAWINGS

Embodiments of the invention will be detailed hereinafter described with references to accompanying drawings in which

In reference to 10.

FIG. 12 is a final preferred view illustration of the said dual purpose Paint tray in the inverted position showing a separation arrangement, namely the said 180 mm and 100 mm or the like.

DETAILED DESCRIPTION OF THE DRAWINGS

Figure 1:
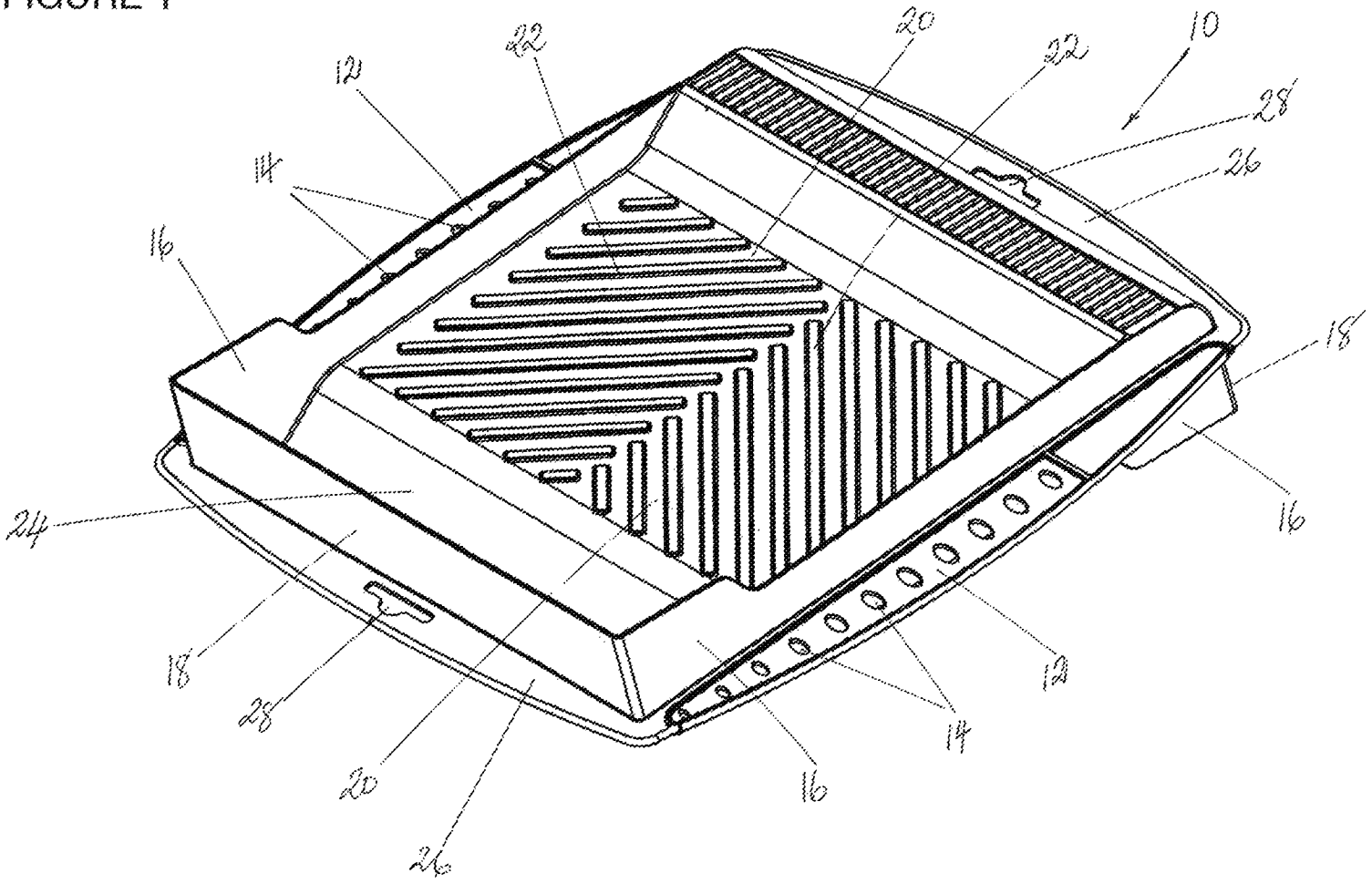
FIG. 1 is a perspective view illustration of a preferred embodiment of the said inverted Paint tray, comprises means the said integral Paint stirrer implements abutted either side in a fixed position, optimizing the conventional herringbone embossed ribs on a planar incline and paint reservoir accordingly, also showing the prehensile grip means and storage orifice.

The preferred embodiments showing in reference 10 of FIG. 1, comprises a perspective view illustration of the aforementioned dual purpose inverted Paint tray encapsulates the integral binary Paint stirrer implements extends abutted either side 12, within a securement means, maximizing a plurality of orifices 14, for the paint to ingress through therein, respectively defining the junction of wall 16 and 18, parallel or the like. Incorporating the incline planar base platform 20, together with the raised embossed ribs 22, the Paint reservoir 24, optimizing at the distal ends of the said Paint tray, the prehensile handles 26, a grip means for handling also within the embodiments orifices 28, for storage.

Figure 2:
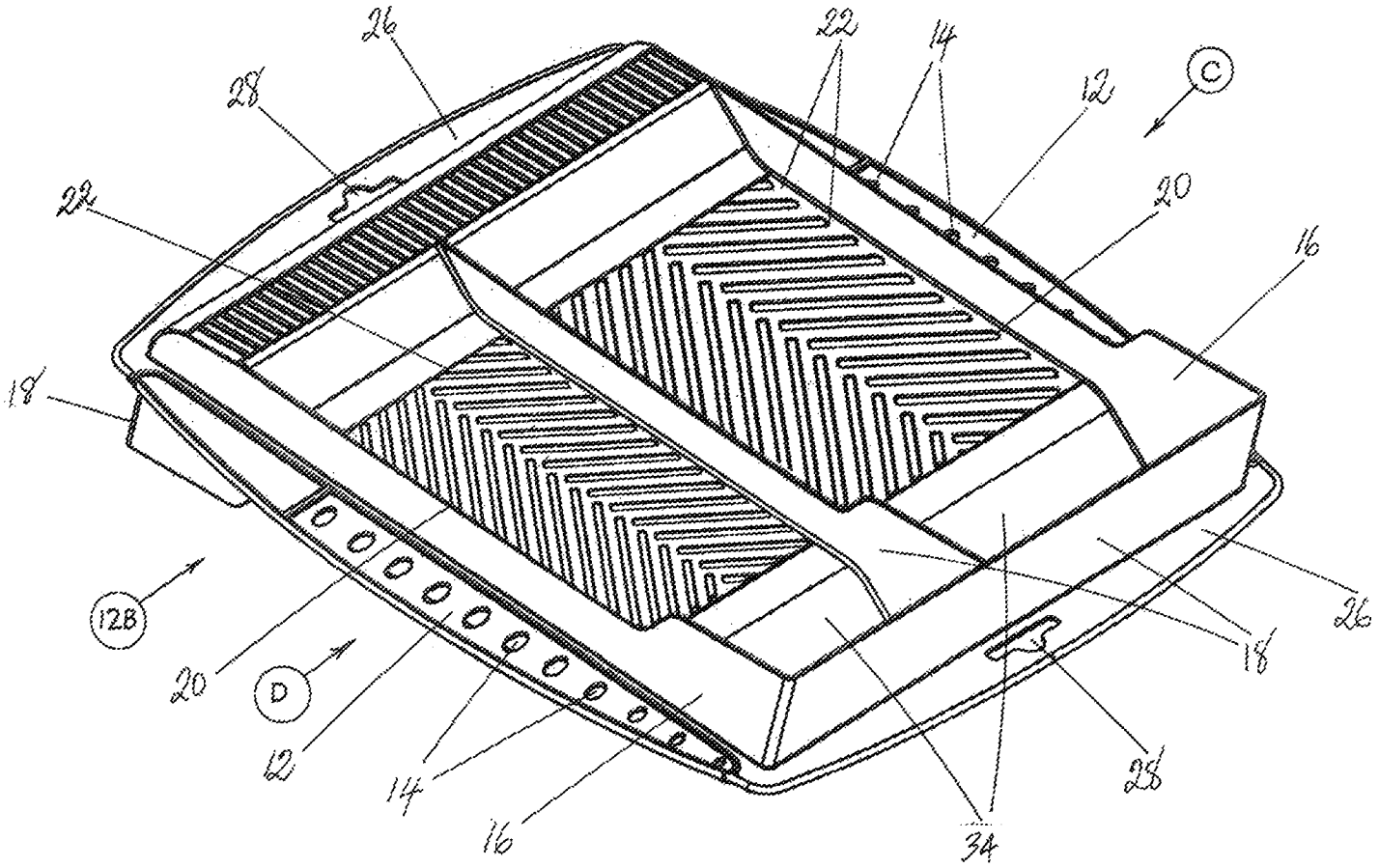
FIG. 2 is another preferred perspective view illustration of the aforementioned described Paint tray embodiments in the desired inverted position, showing two smaller Paint trays, abutted together within a divider vertical wall separating them, again the Paint stirrer implements abutted either side in the said fixed position together with the said herringbone ribs on a planar incline, showing the Paint reservoir and the prehensile grip means and storage orifices.

FIG. 2 is another preferred perspective view illustration of the dual purpose Paint tray in the desired inverted position encapsulates two smaller Paint trays, whereby reference C and D houses the 180 mm and 100 mm tray or the like comprises the abutted binary Paint stirrer implements 12, are housed in a securement means, the said plurality of orifices 14, are for the ingress of paint to dispense through. Incorporating the wall junctions 16 and 18, parallel or the like, comprises again the incline planar base platform 20, the raised embossed ribs 22, and the Paint reservoir 24, together with the said prehensile grip means handles 26, and orifices 28, for storage.

Figure 3:
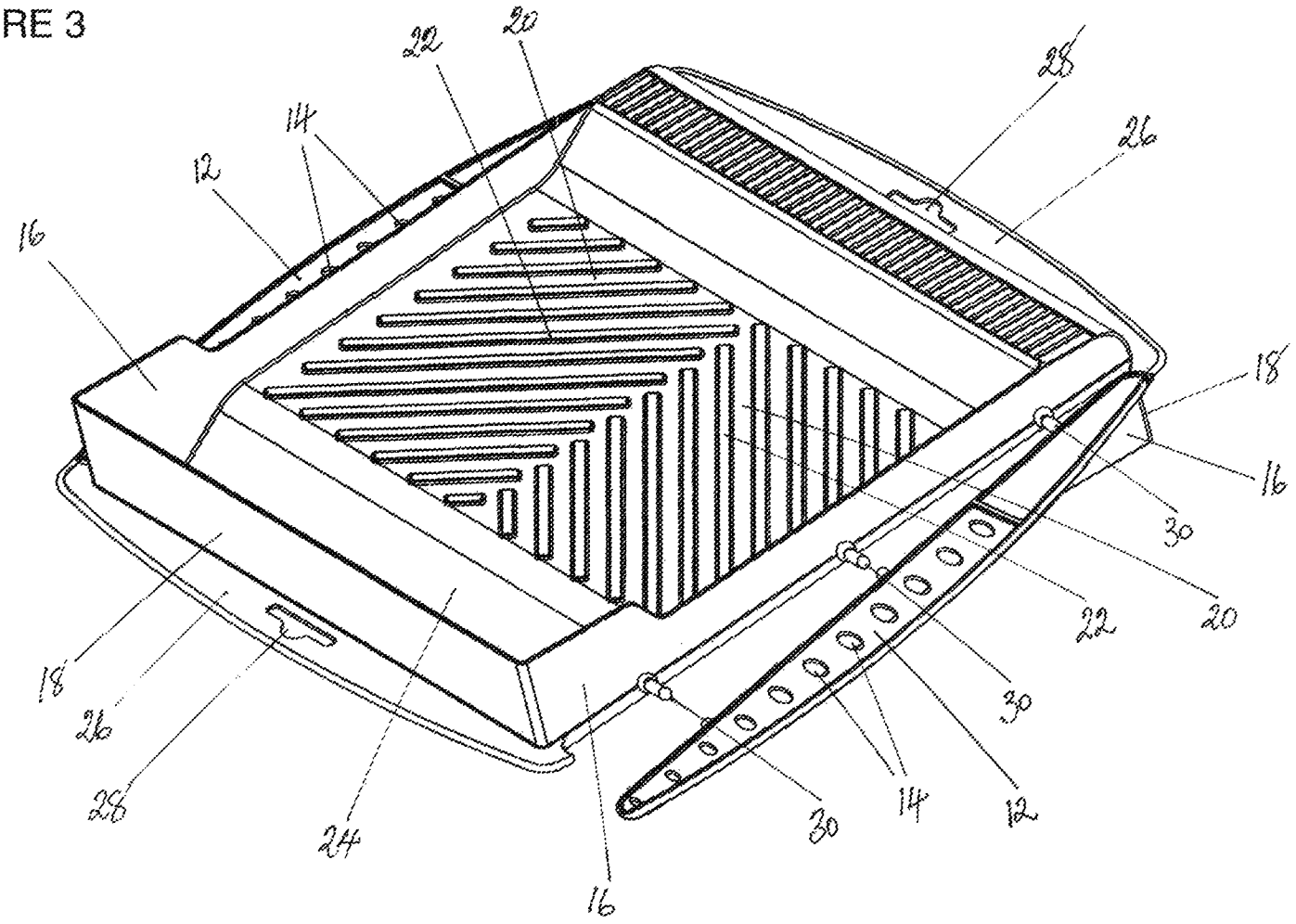
FIG. 3 is another preferred perspective view illustration again of the aforementioned described embodiments of the inverted Paint tray, showing one side the integral Paint stirrer implement in a desired detachable position.

FIG. 3 is another preferred perspective view illustration of the aforementioned described Paint tray whereby it is inverted back again as FIG. 1 one of the binary Paint stirrer implements 12, is in a detachable means in a said desired position, the said orifices 14, for the said ingress of paint, comprises the securement means mechanism 30, or the like, the said wall functions 16 and 18, parallel or the like, encapsulating again the incline planar base platform 20, again the raised embossed ribs 22, and the paint reservoir 24, together with the said prehensile grip means handles 26, and orifices 28, for said storage.

Figure 4:
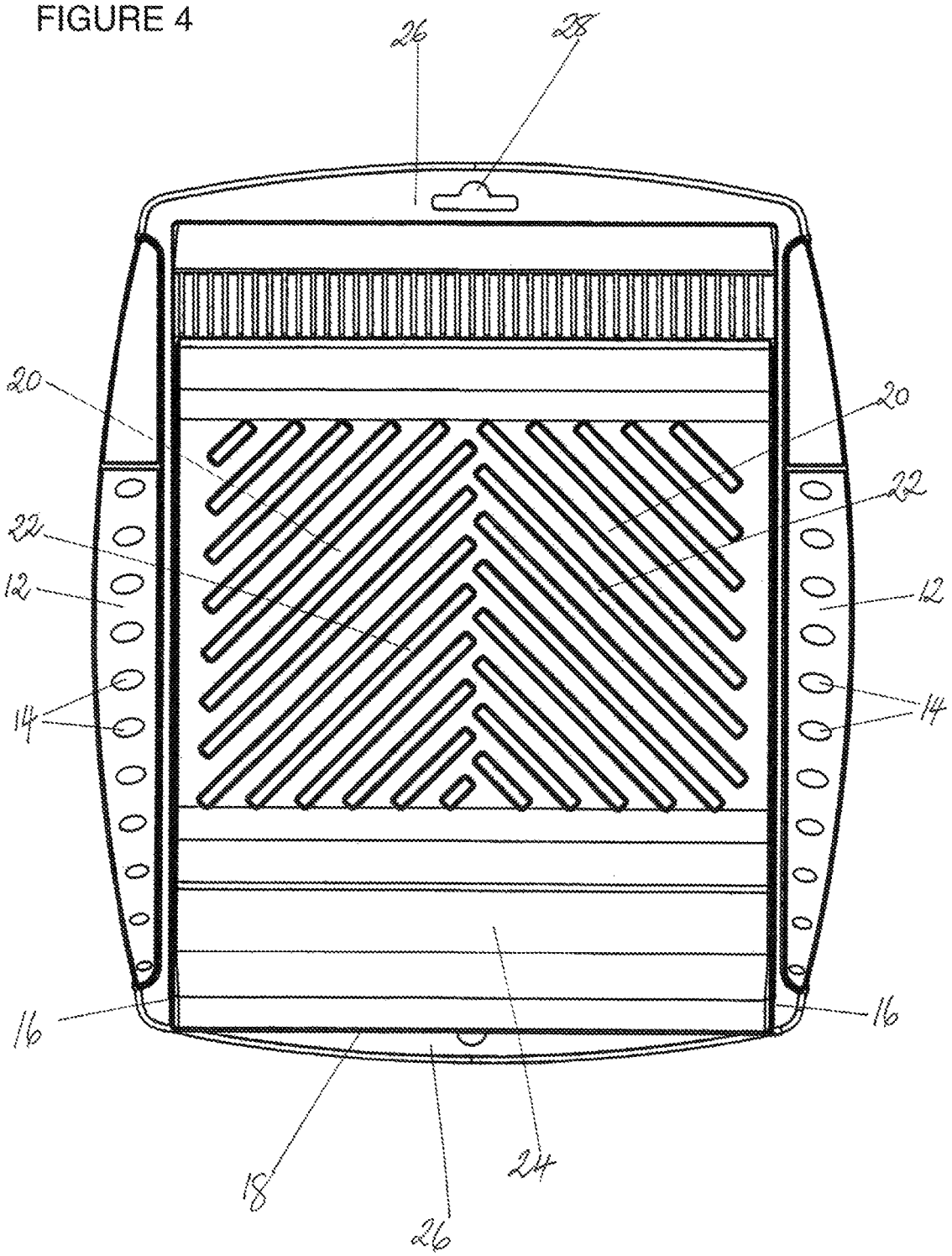
FIG. 4 is a plan view illustration of the said inverted Paint tray, encapsulates the integral Paint stirrer implements abutted either side together with the aforementioned described embodiments.

FIG. 4 is another preferred plan view illustration of the said inverted Paint tray apparatus, with again the said described embodiments encapsulates again the integral binary Paint stirrer implements 12, abutted either side in a fixed means, again a plethora of orifices 14, respectively maximizing the junction of the wall 16 and 18, again parallel or the like, together with the incline planar base platform 20, and said embossed raised ribs 22, and Paint reservoir 24, incorporating the prehensile grip means handles 26, at the said distal ends and orifices 28, for storage.

Figure 5:
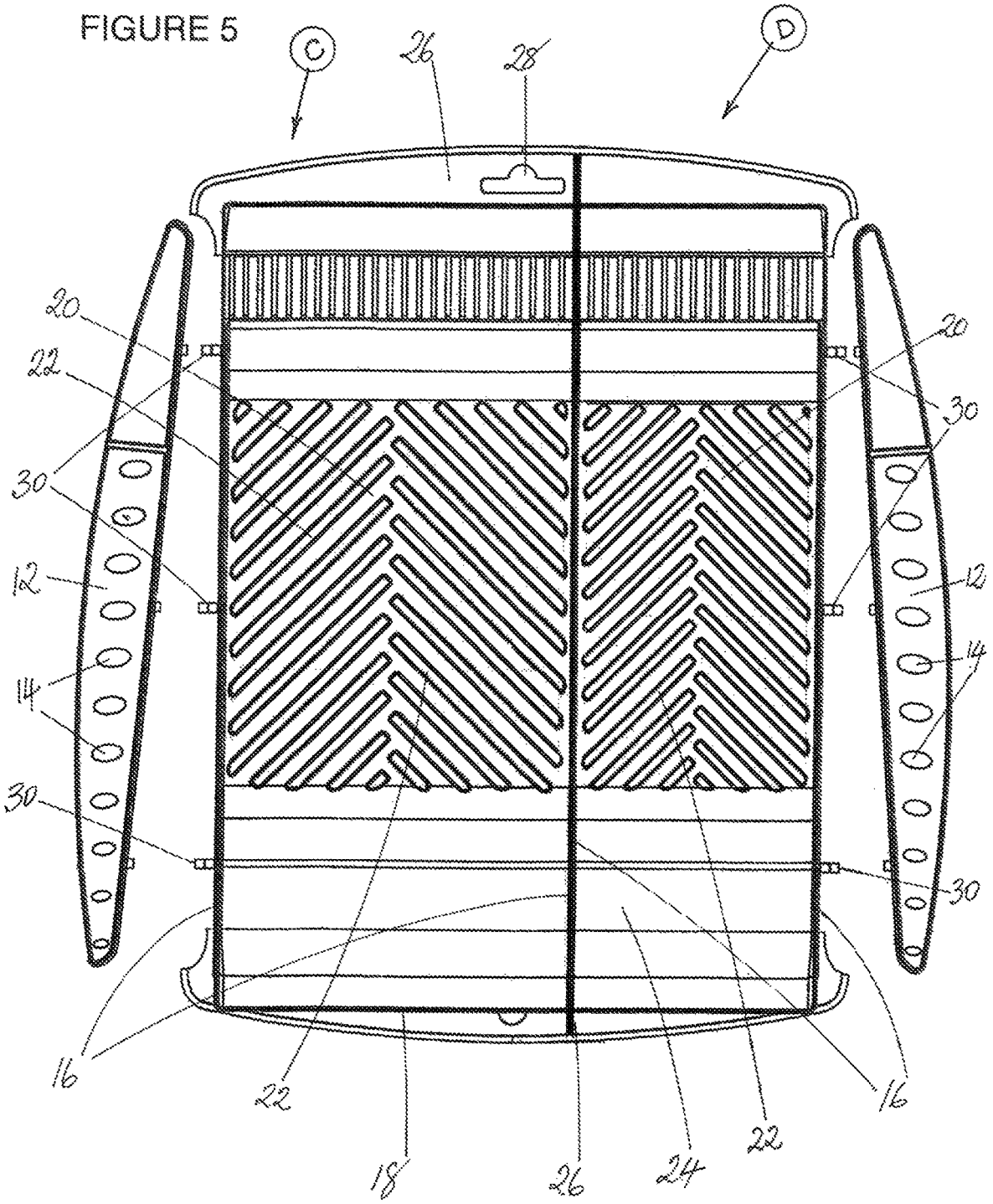
FIG. 5 is another preferred plan view illustration of the aforementioned inverted Paint tray comprises again the tray in the desired inverted position encapsulating the said two smaller Paint trays in an abutted configuration with a said divider wall in a vertical means. The Paint stirrer implements are in a desired detachable arrangement with said described embodiments.

FIG. 5 is yet another preferred plan view illustration of the said inverted Paint tray apparatus in the said inverted position, showing the two smaller Paint trays in reference C and D, houses the 180 mm and 100 mm sizes or the like, encapsulates the integral binary Paint stirrer implements 12, in a desired detachable means, together with the plethora of orifices 14, for the ingress of paint, comprises the securement embodiment means 30, or the like, the said wall junction 16 and 18, incorporating the incline planar base platform 20, and raised embossed ribs 22, the said Paint reservoir 24, and the said prehensile grip means handles 26, the said orifices 28, for storage.

Figure 5A:
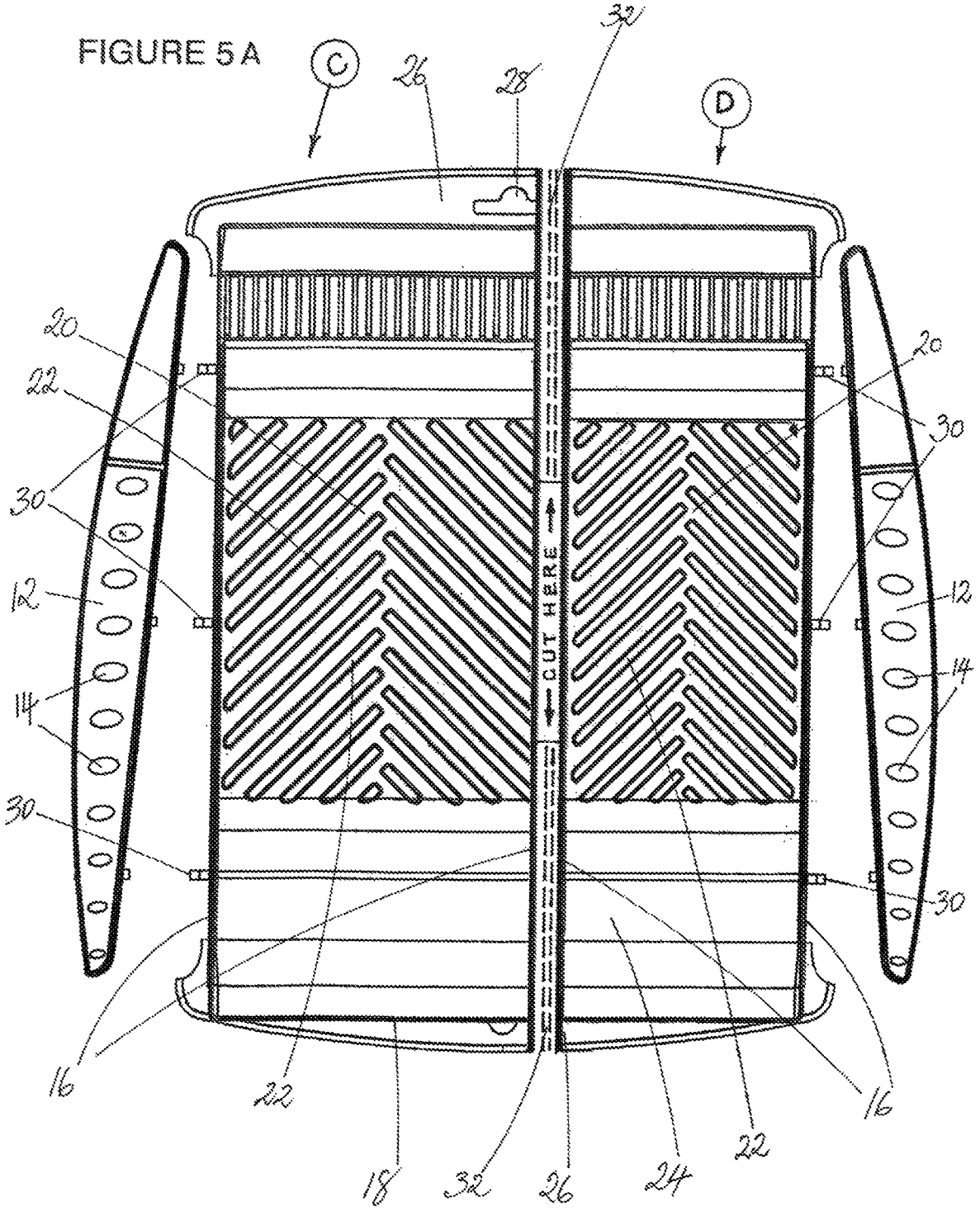
FIG. 5A is another preferred plan view illustration of the said inverted Paint tray in the said desired inverted position now comprises the two smaller trays separated by a width to a predetermined size, retaining their independent wall sizes, with a cutting separating means in a gutter arrangement.

FIG. 5A is yet another variation preferred plan view illustration of the said inverted Paint tray in the said desired inverted position showing again the two smaller Paint trays in the said reference C and D, houses the 180 mm and 100 mm sizes or the like, with the exception that they house their own individual walls 16 and 18 respectively, comprises again the described embodiments whereby the integral binary Paint stirrer implements 12, are in the desired detachable means, together with the plethora or said orifices 14, for the ingress of paint, comprises the securement embodiment means 30, or the like, incorporating the incline planar base platform 20, and raised embossed ribs 22, the said Paint reservoir 24, and said prehensile grip means handles 26, said orifices 28, for storage, also showing the dividing gutter 32, for cutting and separating the two smaller Paint tray C and D, with a hacksaw or Stanley knife respectively.

Figure 6:
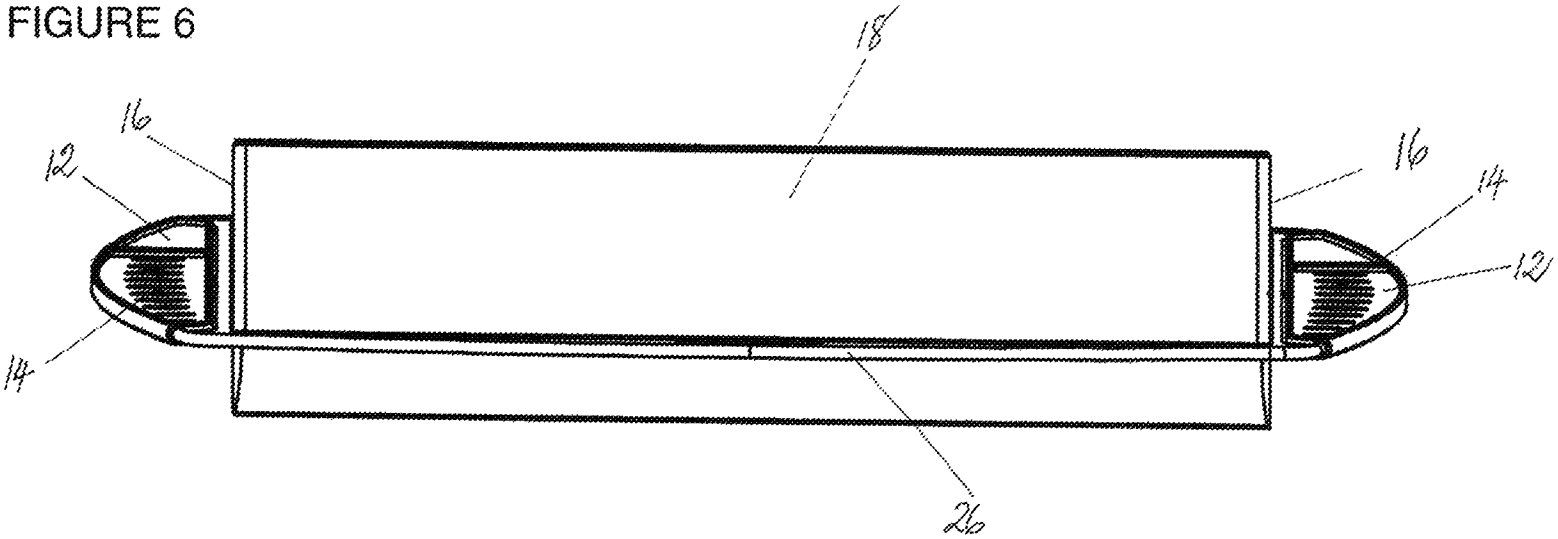
FIG. 6 is another preferred embodiment showing the end elevation view of the aforementioned Paint tray encapsulating again the integral Paint stirrer implements in a perspective end view arrangement alternatively at the distal end of the Paint reservoir.

FIG. 6 is yet another preferred end elevation view illustration comprises means the ear wall junction 18, together with the side walls 16, opposing each other, also encapsulating the said integral binary Paint stirrer implements 12, in a perspective view arrangement and said orifices 14, abutted either end in a securement means configuration.

Figure 7:
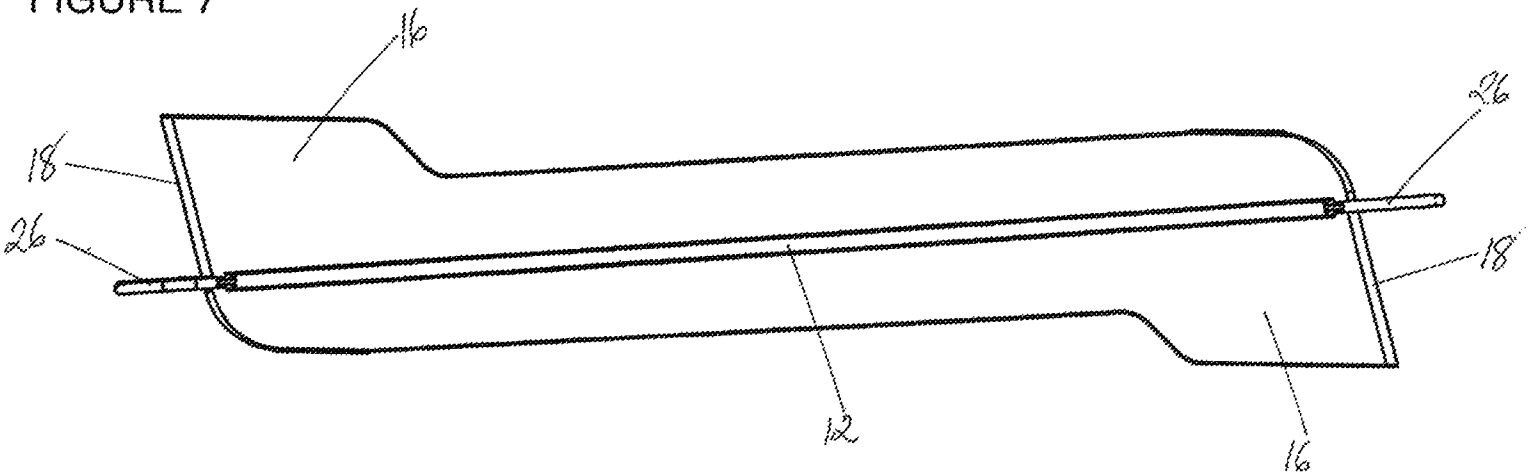
FIG. 7 is another preferred side view illustration of the said Paint tray clearly defining novel dual purpose inverted Paint tray embodiments showing the incline planar, the Paint stirrer implements and the said Paint reservoirs at the opposing ends.

FIG. 7 is another preferred side elevation view illustration again comprises means the integral inverted concept clearly, whereby the said integral binary Paint stirrer implements 12, are defined. The said side walls 16, are in the said inverted position, and said rear walls 18, are shown at a predetermined angle or the like, incorporating the said prehensile grip means handles 26, at opposing ends.

Figure 8:
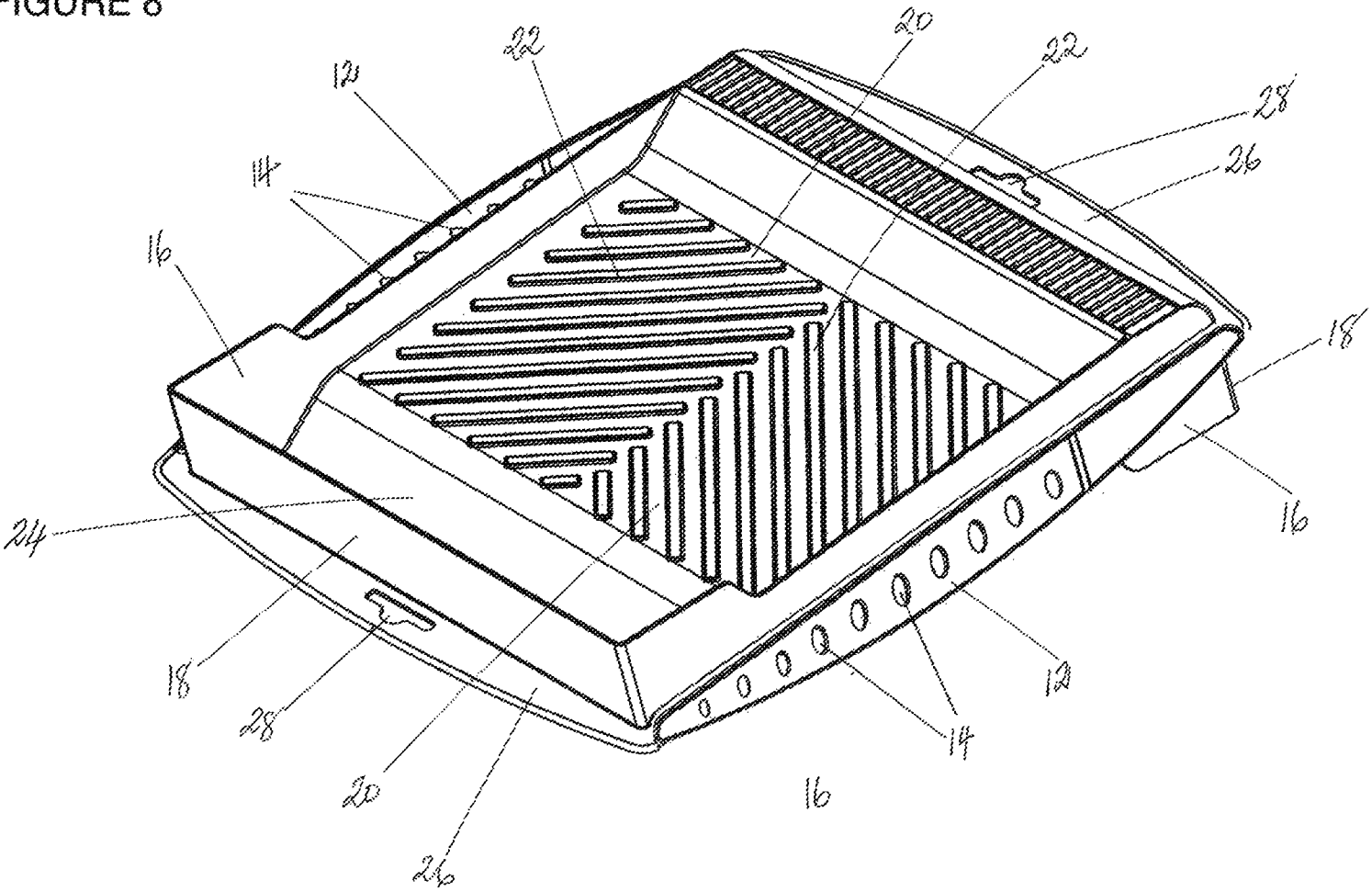
FIG. 8 is a final preferred embodiment showing the said Paint tray and the integral Paint stirrer implements in another desired perpendicular position, housed and abutted in a parallel arrangement either side of the aforementioned Paint tray.

FIG. 8 is a final preferred perspective view illustration of the said mono or dual sided Paint tray encapsulates again the integral binary Paint stirrer implements 12, housed in a perpendicular arrangement parallel to the side walls 16, extends abutted either side within a securement means, maximizing again a plurality of orifices 14, for the ingress of paint, defining the junction of walls 16 and 18, parallel or the like, encapsulating again the incline planar base platform 20, and raised embossed ribs 22, and the Paint reservoir 24, at the said distal ends the prehensile grip means 26, and orifices 28, for storage.

Figure 9:
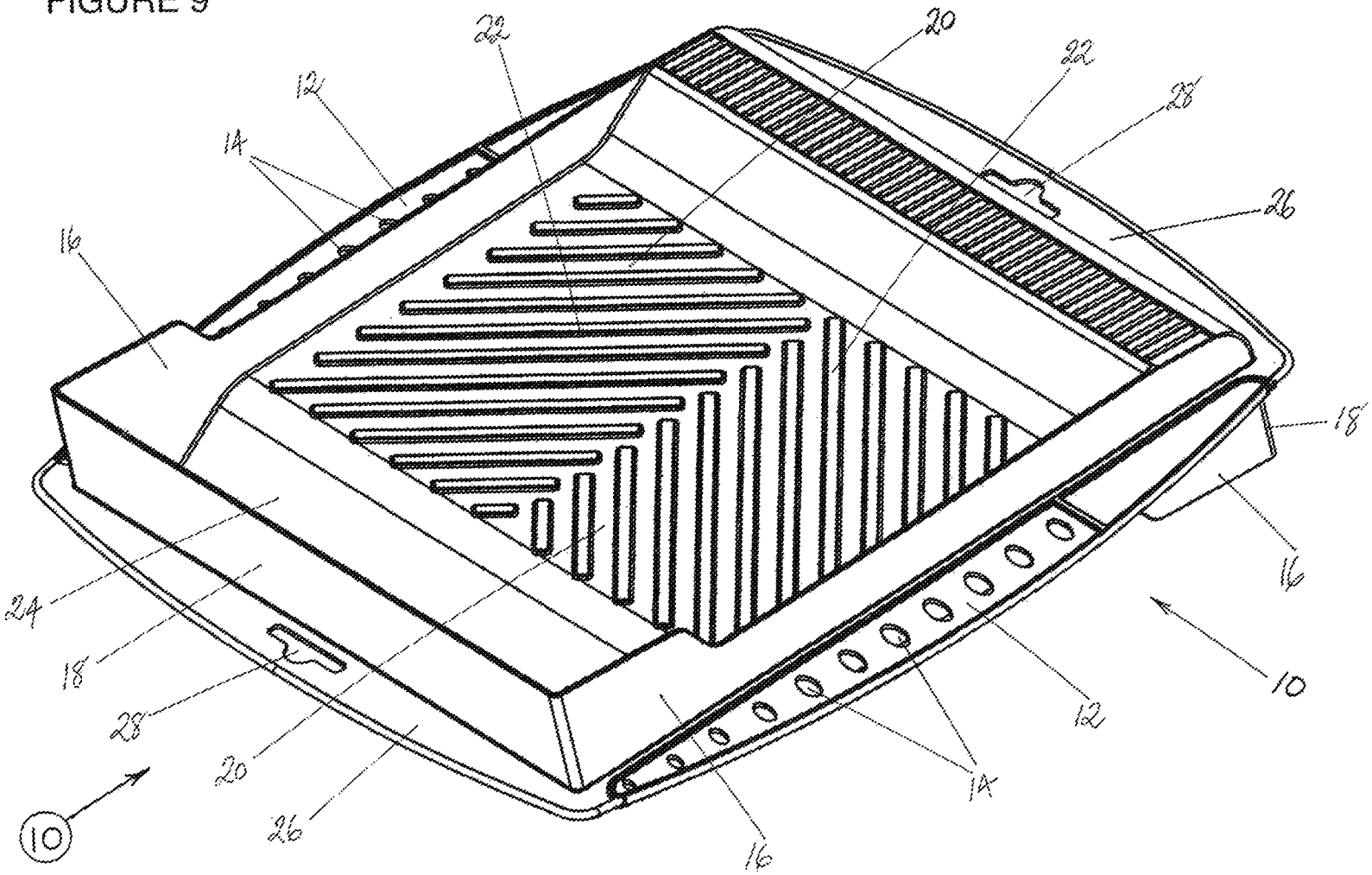
FIG. 9 is another preferred perspective view illustration of the said dual purpose inverted Paint tray. Please refer to FIG. 1 for a detailed description, knowing that this said inverted Paint tray being the larger size 270 mm is common for FIG. 10, FIG. 11, FIG. 11A and FIG. 12 when inverted.

FIG. 9 is another preferred perspective view illustration of reference 10, of the aforementioned dual purpose inverted Paint tray. Please refer to FIG. 1 for a detailed description which shows when the larger size Paint tray 270 mm when inverted is common for FIG. 9, FIG. 10, FIG. 11 and FIG. 11A, and FIG. 12.

Figure 10:
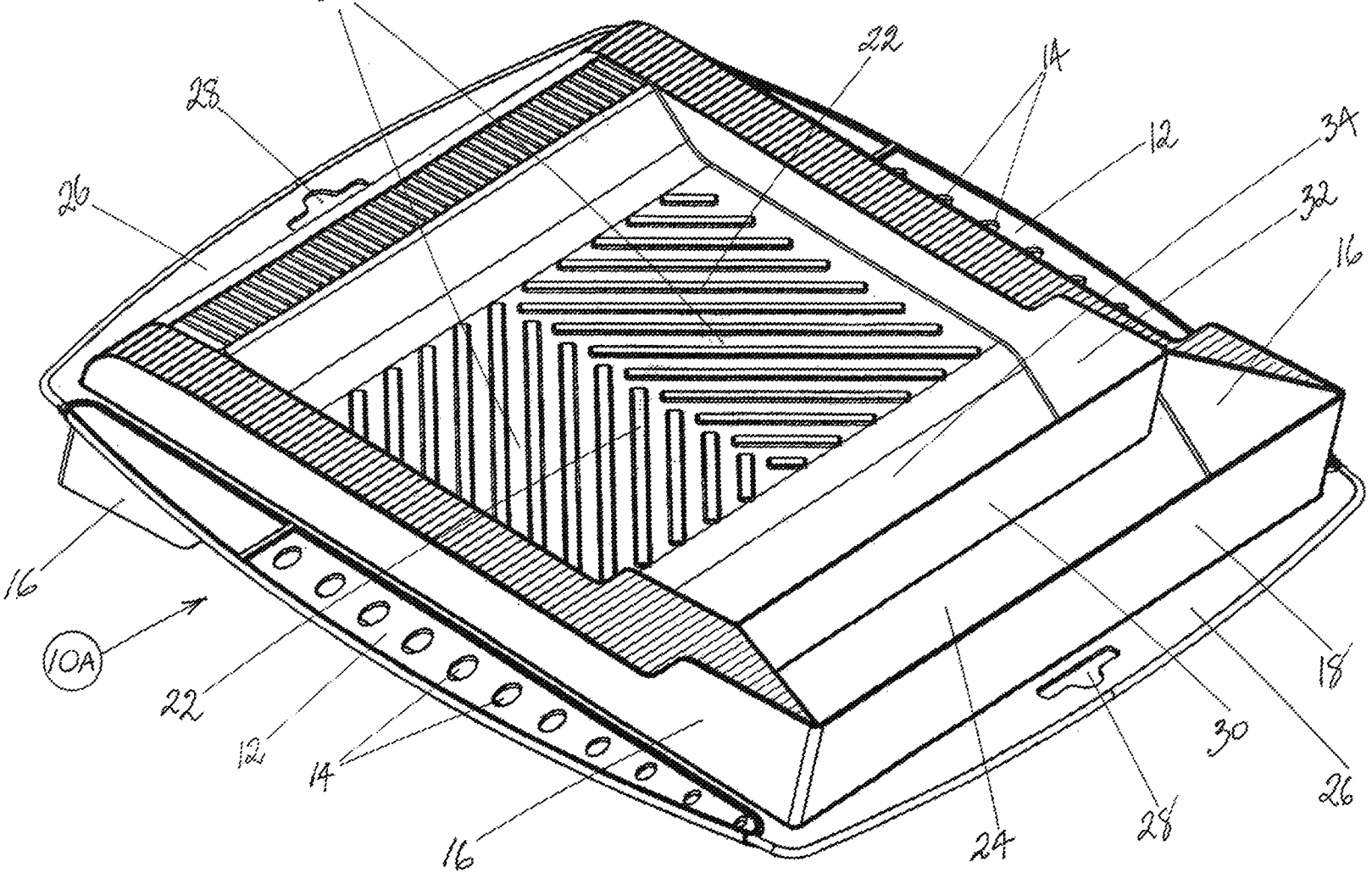
FIG. 10 is another perspective view illustration of the said dual purpose inverted Paint tray means now in the inverted position, the larger Paint tray 270 mm, encapsulates the second smaller Paint tray 230 mm or the like, also houses dual Paint reservoirs.

FIG. 10 is another preferred perspective view illustration of reference 10A, of the said dual sided invested Paint tray, showing the second smaller surface, of the second smaller Paint tray 230 mm or the like, in the desired inverted position, housed and encapsulated within the larger embodiment of the larger Paint tray 270 mm or the like comprises again the binary Paint stirrer implements 12, extends again abutted either side within a securement means, with a plurality of orifices 14, defining the junction of wall 16 and 18 on the larger Paint tray embodiments, and 30 and 32 on the smaller Paint tray, both parallel or the like. Incorporating again the incline planar base platform 20, and the embossed ribs 22, the dual Paint reservoir 24, on the larger Paint tray embodiment, and 34, on the smaller Paint tray embodiment. Defining again at the distal ends the prehensile grip means 26, on the larger Paint tray and orifices 28, for storage.

Figure 11:
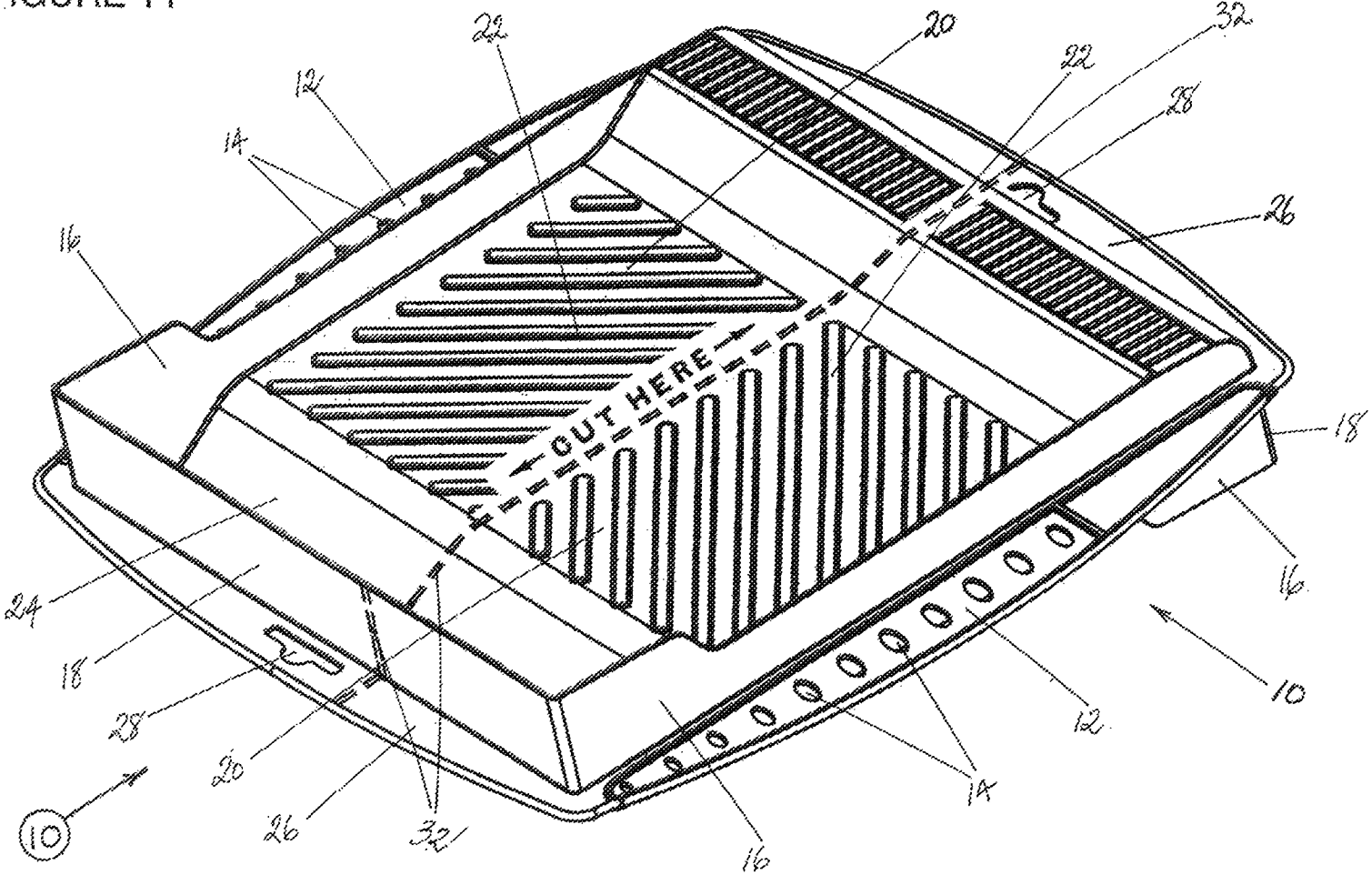
FIG. 11 is another preferred view illustration of the said dual purpose inverted Paint tray showing the surface of the 270 mm Paint tray embodiment showing the integral cutting means for the separation of the smaller trays when inverted.

FIG. 11 is another preferred view illustration of reference 10 of the dual purpose Paint tray showing the 270 mm surface. Please refer to FIG. 1 for a detailed description, apart from the aforementioned description on the said planar base platform 20, encapsulates a cutting and separating line means 32, for the detaching arrangement on the inverted side of the said smaller Paint trays C & D.

Figure 11A:
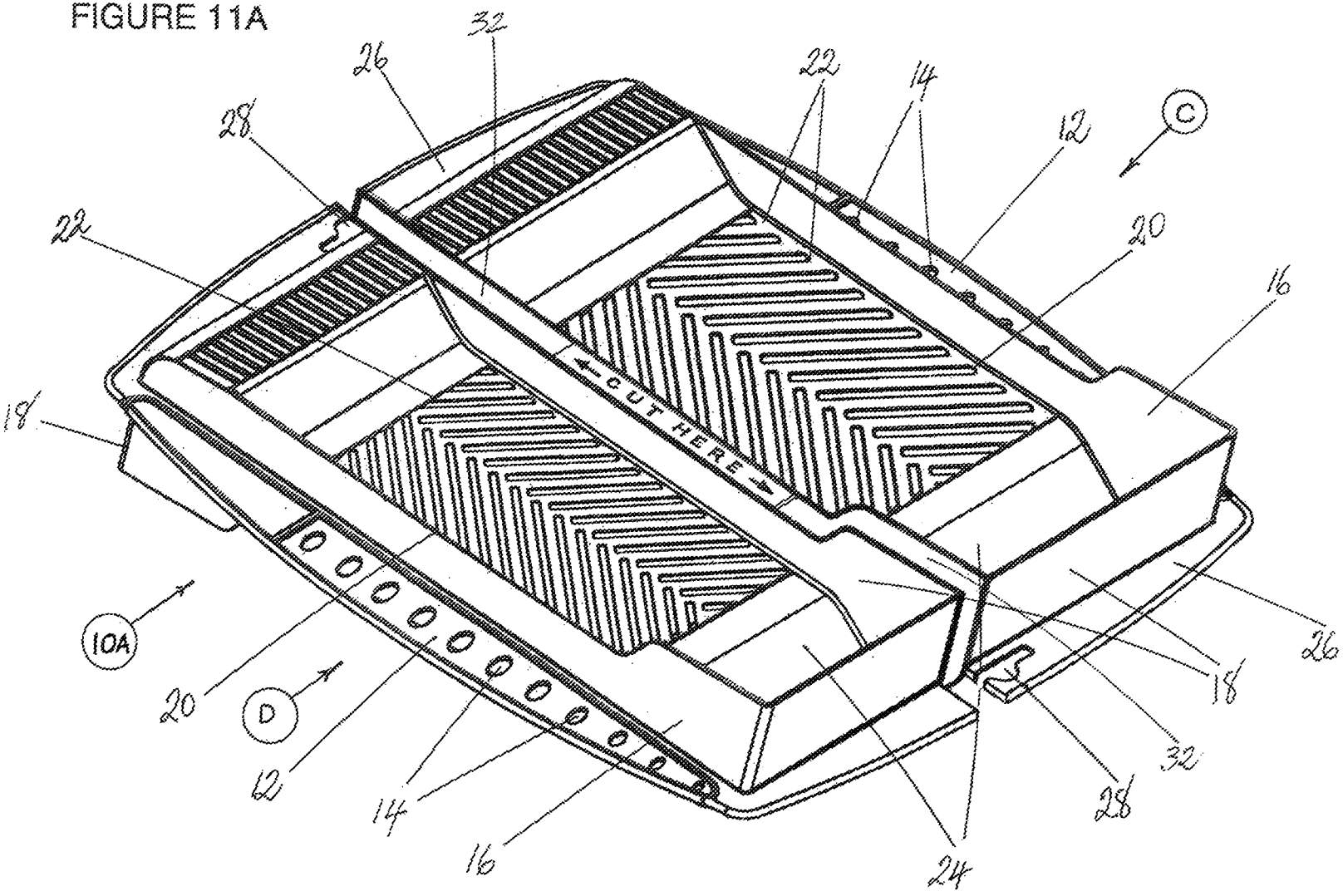
FIG. 11A is another preferred view illustration of the said dual purpose Paint tray now in the said desired inverted position showing the two smaller Paint trays 180 mm and 100 mm or the like, in a conjoin arrangement parallel embodiment with a pre determined size width.

FIG. 11A is another preferred view illustration of reference 10A of the dual purpose Paint tray showing the desired inverted side of the said 270 mm surface now showing the two smaller Paint trays C and D abutted and juxtaposed together comprises the said described embodiments of the said abutted integral binary Paint stirrer implements 12, are housed in a securement means, however the said plurality of orifices 14, defining the junction of wall 16 and 18, incorporating the incline planar base platform 20, and embossed ribs 22, the Paint reservoirs 24, at the distal ends the prehensile grip means 26, and orifices 28, for storage, encapsulating a cutting and separating gutter arrangement 32, for detaching are also shown.

Figure 12:
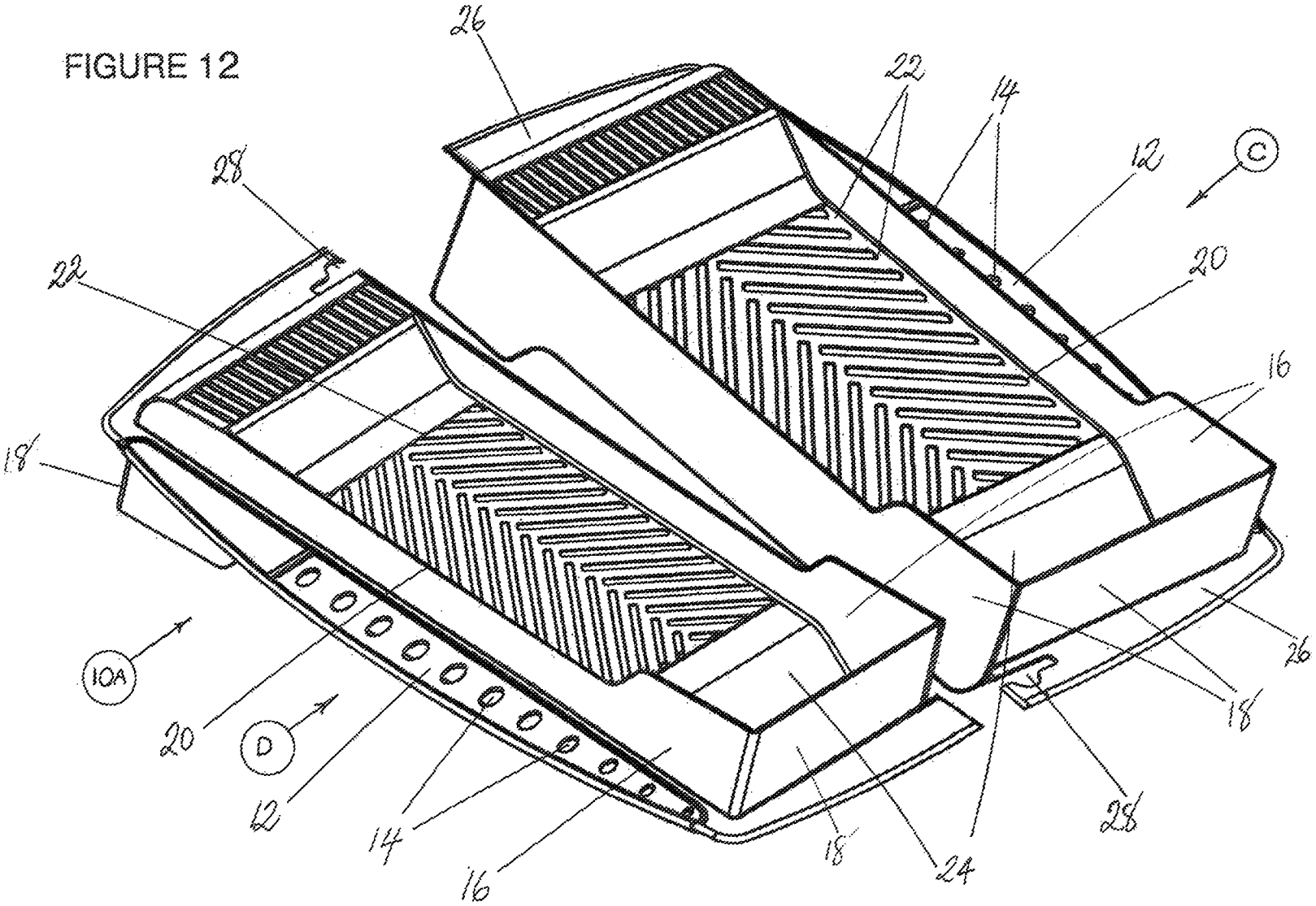

FIG. 12 is a final perspective view illustration of reference 10A, of the dual purpose Paint tray now in the inverted position, encapsulates the two smaller Paint trays C and D in a separation arrangement reference C being 180 mm and D, being 100 mm or the like comprises again the integral binary Paint stirrer implements 12, in a said securement means housed either side with a plurality of orifices 14, for the ingress of paint, incorporates the independent wall junction 16 and 18, defining the planar base platform 20, together with the embossed ribs 22, also encapsulates the Paint reservoir 24.

It may be observed that this present invention provides a simple, effective and innovative way of a new Paint tray with a novel appended means in the field of the Painting and Decorating industry.

Since modifications within the scope of the concept may be readily used by the consumer in the field, it may be understood this invention is not restricted to the particular embodiments described by way of example hereinafter.

The invention claimed is:

1. A paint tray comprising:

a dual sided planner platform having a plurality of raised ribs;

four side walls perpendicularly extend from edges of said planner platform defining thereby a top tray section on one side of said planner platform and an inverted tray section on an opposing side of said planner platform, said side walls are configured such that said top tray section and said inverted tray section are inclined with respect to said side walls;

detachable stirring elements attached to said side walls, said detachable stirring elements including a plurality of orifices configured for ingress of paint therethrough;

a paint reservoir defined at one end of said dual planner platform.

2. The paint tray of claim 1 further comprising gripping sections defined on a first two opposing side walls of said four sidewalls wherein said detachable stirring elements are coupled to a second two opposing side walls of said four sidewalls.

3. The paint tray of claim 1 wherein further comprising a dividing gutter defined along said opposing side of said planner platform dividing said inverted tray section to a first and second sub sections.

4. The paint tray of claim 3 wherein said dividing gutter extends between two opposing side walls of said four sidewalls, and is configured for cutting the tray into two separate trays.

* * * * *